US006025678A

United States Patent [19]

Faillon et al.

[11] Patent Number: 6,025,678

[45] Date of Patent: Feb. 15, 2000

[54] LINEAR-BEAM MICROWAVE TUBE WITH OUTPUT CAVITY BEYOND THE COLLECTOR

[75] Inventors: Georges Faillon, Meudon; Jean-Luc Piquet, Les Ulis, both of France

[73] Assignee: Thomson Tubes Electroniques, Meudon la Foret, France

[21] Appl. No.: 08/986,787

[22] Filed: Dec. 8, 1997

[30] Foreign Application Priority Data

Dec. 10, 1996 [FR] France ..... 96 15158

[51] Int. Cl.[7] ..... H01J 23/40; H01J 23/027

[52] U.S. Cl. ..... 315/5; 315/5.38; 315/5.39; 313/45; 313/46

[58] Field of Search ..... 315/4, 5, 5.38, 315/5.39; 313/45.46

[56] References Cited

U.S. PATENT DOCUMENTS

| | | | |
|---|---|---|---|
| 3,097,324 | 7/1963 | Salisbury | 315/5.39 |
| 3,312,857 | 4/1967 | Farnsworth | 315/5 |
| 3,775,635 | 11/1973 | Faillon et al. | 315/5.43 |
| 3,846,665 | 11/1974 | Firmain et al. | 315/5.43 |
| 4,151,325 | 4/1979 | Welch | 315/5 |
| 4,173,744 | 11/1979 | Faillon et al. | 333/33 |
| 4,189,660 | 2/1980 | Dandl | 315/4 X |
| 4,243,961 | 1/1981 | Faillon et al. | 333/233 |
| 4,388,555 | 6/1983 | Symons et al. | 315/4 |
| 4,482,843 | 11/1984 | Perring | 315/4 |
| 4,591,799 | 5/1986 | Faillon et al. | 330/45 |
| 4,733,131 | 3/1988 | Tran et al. | 315/5.14 |
| 4,749,906 | 6/1988 | Tran et al. | 315/5 |
| 4,827,192 | 5/1989 | Tran et al. | 315/5.39 |
| 4,897,609 | 1/1990 | Mallavarpa | 315/4 X |
| 4,933,594 | 6/1990 | Faillon et al. | 315/153 |
| 5,043,630 | 8/1991 | Faillon et al. | 315/5 |
| 5,109,179 | 4/1992 | Faillon et al. | 313/153 |
| 5,180,944 | 1/1993 | Neilson | 315/5 |
| 5,225,739 | 7/1993 | Faillon et al. | 315/5.43 |

FOREIGN PATENT DOCUMENTS

| | | | |
|---|---|---|---|
| 0 122 834 A1 | 10/1984 | European Pat. Off. . | |
| 273833 | 12/1986 | Japan | 315/5 |
| 6725 | 1/1988 | Japan | 315/4 |
| 276541 | 11/1989 | Japan | 315/4 |
| 2 096 392 | 10/1982 | United Kingdom . | |
| 2 145 576 | 3/1985 | United Kingdom . | |

*Primary Examiner*—Benny T. Lee
*Attorney, Agent, or Firm*—Oblon, Spivak, McClelland, Maier & Neustadt, P.C.

[57] ABSTRACT

A linear-beam microwave tube comprises at least one electron beam directed along an axis crossing a cavity known as an output cavity in which it interacts with a microwave, this cavity having a terminal wall that separates it from a collector, the electron beam penetrating the collector by at least one aperture in the terminal wall. The terminal wall furthermore comprises at least one coupling unit to couple the output cavity with the collector, the microwave having to circulate in the collector before being extracted therefrom. Applications: klystrons and travelling-wave tubes that are easy to mount and inexpensive.

20 Claims, 5 Drawing Sheets

SECTION A-A

SECTION B-B'

SECTION C-C'

LINEAR-BEAM MICROWAVE TUBE WITH OUTPUT CAVITY BEYOND THE COLLECTOR

BACKGROUND OF THE INVENTION

The present invention pertains to linear beam or "O" type cavity microwave tubes.

The term "linear-beam microwave tubes" refers to a tube that uses a focusing magnetic field that is substantially parallel to the path of the electrons of the beam. These tubes make use of the interaction between the electrons of the beam that are moving together and a microwave.

These tubes may be klystrons or coupled-cavity travelling-wave tubes and their derivatives.

A standard klystron has an electron gun that produces a long and thin electron beam through a sequence of cavities connected to one another by drift tubes. At the output of the last cavity, the electrons are gathered in a collector that is coaxial with the beam. This collector gets heated and it is cooled, for example by making a cooling fluid circulate at its periphery.

A focusing device surrounds the cavities. It prevents the electrons from diverging. This focusing device is often formed by an electromagnet in the form of a hollow cylinder.

A microwave signal to be amplified is introduced into the cavity nearest to the gun. The output cavity or the cavity closest to the collector is designed to be connected to a user device by means of a transmission line, this transmission line conveying the amplified microwave signal towards the user device. This transmission line is a rectangular, circular or coaxial waveguide.

This waveguide is generally positioned transversally to the electron beam. The coupling between the output of the cavity and the waveguide is done by at least one hole in the side wall of the cavity.

A window may block the coupling hole. It is designed to let through the microwave signal extracted while at the same time maintaining the high vacuum that prevails within the cavity.

Since the transmission line is connected to a side wall of the output cavity, the focusing device must take account of this link and must include a notch at this place. The magnetic field is reduced and dissymmetrical at the output cavity while this is the place where it is most needed. Consequently, the electron beam is defocused.

This transversal transmission line also gives rise to a considerable difficulty during the installation of the tube. The assembly formed by the gun, the cavities and the collector has to be slid into the focusing device and the relative position of the assembly and of the device has to be adjusted in order to fix the transmission line. This operation is very delicate because of the weight involved and the fragile nature of the link. The assembly formed by the gun, cavities and collector weighs several hundreds of kilograms.

Proposals have already been made to overcome these drawbacks in the magnetic field and simplify the assembly by using a transmission line that surrounds the collector. However, this arrangement has a major drawback. The collector is limited in size and hardly accessible. It is difficult to cool and therefore costly. This configuration is reserved for low-power tubes.

The present invention seeks to make a linear-beam cavity microwave tube that has neither a dissymmetry of the magnetic field nor a small-sized collector, is very simple to mount and costs little.

To achieve these ends, the present invention proposes to make the microwave signal to be extracted and the electrons of the beam exist together in the collector.

SUMMARY OF THE INVENTION

An object of the invention is a linear-beam microwave tube comprising at least one electron beam directed along an axis, crossing a cavity known as an output cavity in which it interacts with a microwave, this cavity having a terminal wall that separates it from a collector, the electron beam penetrating the collector by at least one aperture in the terminal wall, wherein the terminal wall furthermore comprises at least one coupling unit to couple the output cavity with the collector, the microwave having to circulate in the collector before being extracted therefrom.

The coupling unit may be an iris or a conductive loop for example.

To match the impedance of the collector with that of the output cavity, it is possible to provide for at least one microwave obstacle in the collector.

According to another characteristic of the invention, the collector has one end opposite the output cavity fitted out with a junction flange designed to be connected to a transmission line that has to convey the microwave out of the collector.

So as to maintain a high vacuum within the collector, a microwave window is placed in the collector. It may be substantially transversal to the axis of the electron beam or else substantially parallel to the electron beam.

So as to protect the window from electron bombardment, the collector may contain successive partition walls mounted as baffles upline from the window.

Two successive partitions may have facing portions. These portions are formed by the overlapping at least slightly of the partitions.

The window may have one of its faces covered with a slightly conductive material such as titanium, so as to enable the flow of electrical charges due to the electron bombardment.

The collector may be fitted out externally with means producing a magnetic field aimed at deflecting the electrons before they reach the window.

The collector may comprise a portion that is elbowed so that the microwave is extracted in a substantially transversal direction.

The window may be placed downline with respect to the elbowed potion so that it is protected from electron bombardment and so that it is accessible if cleaning is required.

The collector may comprise a transition so that the cross-section of the units placed downline is different from the cross-section of the upline part of the collector.

A waveguide section fixed to the collector may contribute to forming the elbowed portion. An elbowed waveguide may also be used.

The collector may have a section that is not circular, as is often the case, but rectangular.

The collector may be fitted out externally with a cooling device.

BRIEF DESCRIPTION OF THE DRAWINGS

Other characteristics and features of the invention shall appear from the following description of exemplary tubes according to the invention illustrated by the appended figures, of which.

FIG, 1*a* shows a longitudinal section of a tube according to the invention.

DETAILED DESCRIPTION OF THE INVENTION

Figure 1A:
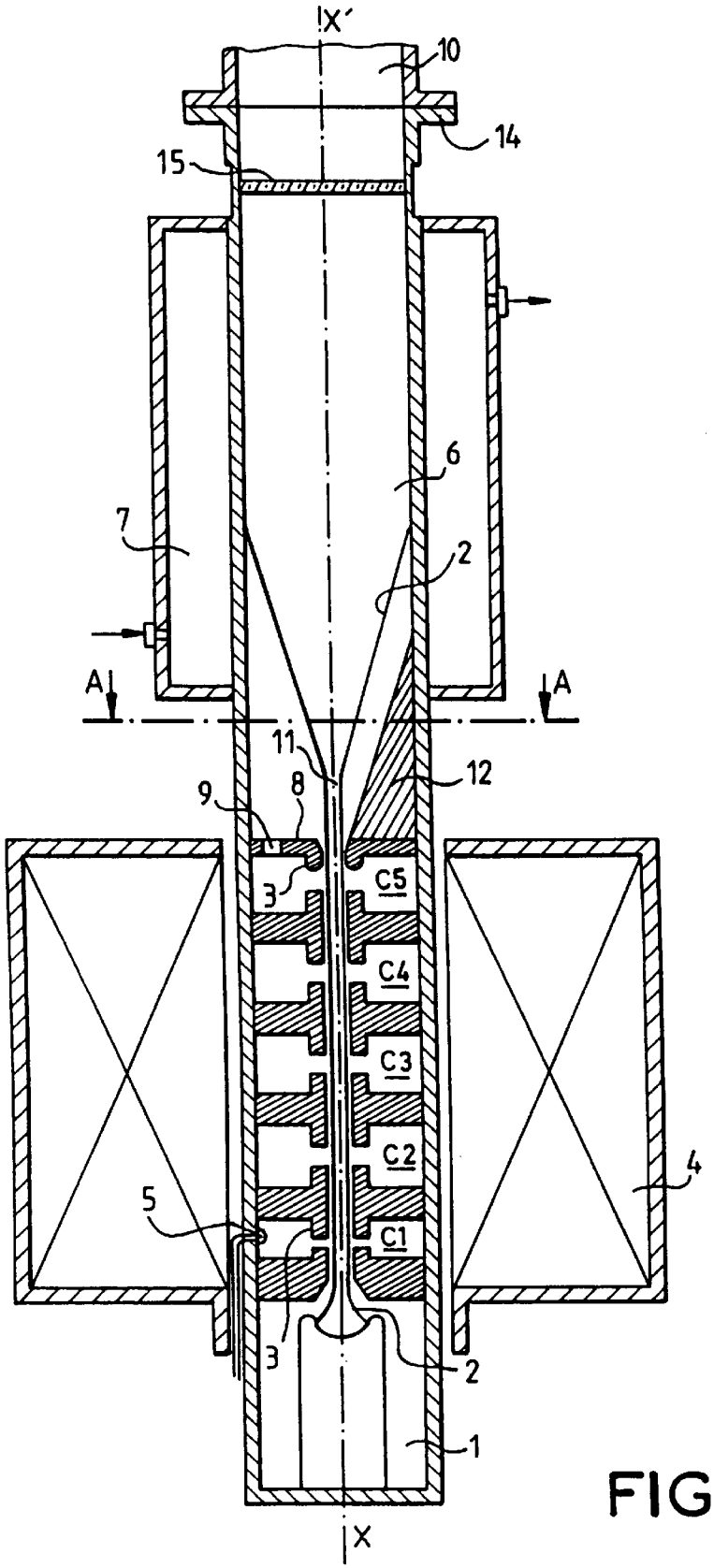
FIG. 1*b* shows a cross-section of the collector of the tube of FIG. 1*a;*
FIG. 1*c* shows the equivalent electrical diagram of the output cavity coupled with the collector of the tube of FIG. 1*a;*
Figure 1C:
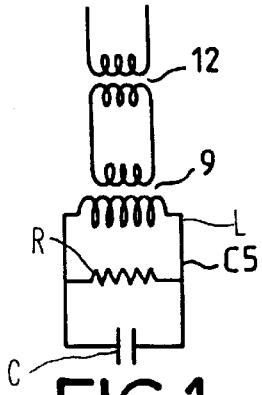
Figure 1B:
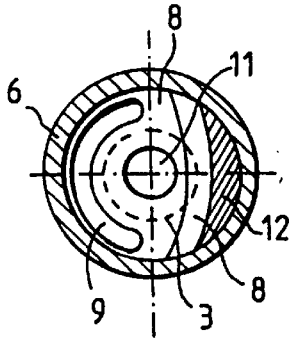

Referring now to the drawings, wherein like reference numerals designate identical or corresponding parts throughout the several views, and more particularly to FIG. 1 thereof, there is illustrated a longitudinal sectional view of a microwave tube according to the invention. FIG. 1*b* shows a cross-section along the axis AA.

The tube shown is a klystron. Conventionally, it has a gun 1 producing a long, thin electron beam 2 with an axis XX'. The electron beam 2 goes through a sequence of cavities C1, C2, C3, C4, C5. They are aligned along the axis XX'. They are separated by drift tubes 3. The cavities C1, C2, C3, C4, C5 are surrounded by a focusing device 4.

The cavity C1 closest to the gun 1 is called an input cavity and the cavity C5 furthest from the gun 1 is called an output cavity. A microwave signal to be amplified is introduced into the input cavity C1 by means of a coupling device 5. It will interact with the electrons which will yield a part of their energy to it.

The electrons of the beam 2, after having crossed the output cavity C5, are collected in a collector 6. The collector 6, which generally has the shape of a hollow cylinder, is shown as being substantially coaxial with the axis XX'. The collector 6 is fitted out externally with a cooling device 7. In the example described, this device works by circulation of fluid.

The output cavity C5 has a terminal wall 8 that separates it from the collector 6. This terminal wall 8 has a passage hole 11 for the electrons.

The collector 6 and the output cavity C5 are electromagnetically coupled by means of at least one coupling unit 9 that is located in the terminal wall 8 but is distinct from the passage hole 11 for the electrons. The microwave signal gets propagated in the collector 6 where it exists together with the electrons of the beam 2.

In the example shown in FIG. 1*a*, the coupling unit 9 is a hole or iris in the terminal wall 8 of the output cavity C5.

The coupling is electrical between the output cavity C5 and the collector 6. The iris 9 intersects the current lines in the output cavity C5. An electric field is induced in the iris and this field excites the electrical component of the propagation mode in the collector 6. This mode is preferably the circular fundamental TE11 mode for it is propagated alone in a wide range of frequencies. It is possible to resort to other modes in the collector 6, in particular by using several holes for the coupling or at least one coupling unit of another type, for example a loop.

It is possible to match the impedance of the collector 6, which is generally equal to some hundreds of ohms, to that of the output cavity C5, which is generally equal to some thousands of ohms, by means of one or more microwave obstacles 12. In FIGS. 1*a*, 1*b*, a wedge 12 can be seen in the collector 6 downline from the terminal wall 8. It is opposite to the coupling unit 9 with respect to the passage hole 11 for the electron. A stud or a series of steps for example, could be used instead of the wedge.

The depth of the collector 6 is conventionally fixed by the expansion of the electron beam 2 when the magnetic field narrows.

It is standard practice to make the terminal wall 8 of the output cavity out of a magnetic material such as soft iron, for example. The magnetic field then drops sharply in the collector 6 as compared with what it was in the output cavity C5. It is also standard practice for the drift tubes to be made out of non-magnetic material, for example copper.

FIG. 1*c* shows an electrical equivalent diagram of the coupling between the output cavity C5 and the collector 6. The output cavity is equivalent to an R, L, C circuit in parallel. The coupling unit 9 is equivalent to a first transformer and the microwave obstacle 12 to a second transformer.

The collector 6 is designed to be connected to a transmission line 10 at its end opposite the output cavity C5. This transmission line 10 is designed to convey the microwave that is extracted from the output cavity C5 and has travelled through the collector 6 to a user device (not shown).

In the example shown in FIG. 1*a*, the transmission line 10 is positioned in the extension of the collector 6 substantially along the axis XX'. The collector 6 ends in a junction flange 14 to which the transmission line 10 is fixed. The transmission line 10 may be a circular, rectangular or even coaxial waveguide. The fact of exciting the fundamental circular mode in the collector has another advantage. It can easily get converted into the rectangular TE10 mode which may be used in the transmission line 10 if it is formed by a rectangular waveguide.

A microwave tube works under vacuum. In general, the user device and the transmission line do not work at the same pressure as the tube. They may work at atmospheric pressure or at greater pressure. A microwave window 15 made of dielectric material is then used to maintain the vacuum within the tube while letting through the microwave in the transmission line 10.

In FIG. 1*a*, the window 15 is placed in the collector 6, at its end opposite the output cavity C5, upline from the junction flange 14. It is substantially transversal to the axis XX'.

The microwave window 15 may be made of aluminium oxide and may be brazed to the collector 6. Its shape depends on its environment. Here, it is matched with the cross-section of the collector 6. It is a disk and the collector has the shape of a cylinder generated by revolution.

The shorter the tube, the more compact is the collector 6 and the greater is the risk that the microwave window 15 may be bombarded by electrons. This bombarding damages it or even risks breaking or piercing it. The electrons that strike the window 15 originate from several sources. There are the electrons which, in penetrating the collector 6 close to the axis XX', have not been deflected. There are the electrons that have been reflected by the wall of the collector as well as the secondary electrons emitted after an impact between a so-called primary electron and the wall of the collector. This bombardment prompts a collection of charges on the window.

It is possible, but only partially, to avoid this accumulation by covering the window with a thin layer of a low-conduction material preferably having a low coefficient of secondary emission such as titanium. The charges may flow towards the walls of the collector 6.

It is also possible to reduce the bombardment of the window by subjecting the collector 6 to a transversal magnetic field upline from the window 15 so that the electrons are deflected before reaching it. This variant is shown in FIGS. 2*a*, 2*b*.

Figure 2A:
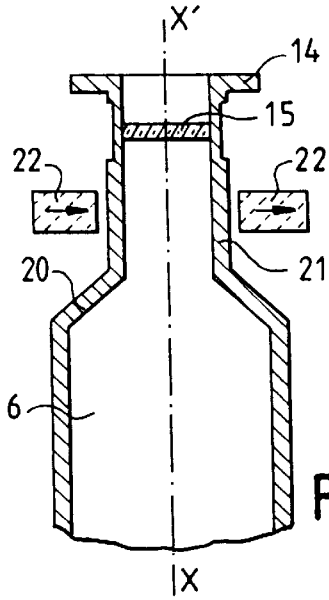
FIGS. 2*a*, 2*b* show two partial longitudinal sections of two variants of a collector of a tube according to the invention.
Figure 2B:
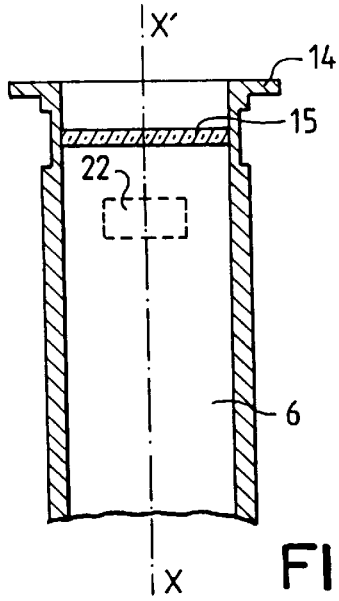

In this example, the collector 6, at its end opposite the output cavity C5, has a transition 20 (FIG. 2A). The collector 6 is then extended by a waveguide portion 21 (FIG. 2A) receiving the window 15 and ends in the junction flange 14. The window 15 is always substantially transversal to the axis XX' and the transmission line (not shown) is always directed along the axis XX'. Depending on the type of transition 20, the waveguide portion 21 receiving the window may have cross-section shape other than that of the collector 6 and/or it may have different dimensions. The transition may, for example, convert a circular guide into a rectangular guide, a rectangular guide into a circular guide and/or obtain a reduction or an increase in dimensions. In the example shown, the transition 20 converts a circular guide into a rectangular guide.

The collector 6 is fitted out externally with means 22 producing a transversal magnetic field upline from the window 15 in such a way as to deflect the electrons passing through this zone so that they do not reach the window 15. Magnets 22 are located on the periphery of the waveguide portion 21.

This variant requires heavy magnets or even electromagnets and a current supply, thus increasing the cost of the equipment.

To prevent the bombardment, it is also possible to place partitions acting as baffles in the collector 6, upline from the window 15.

Figure 3C:
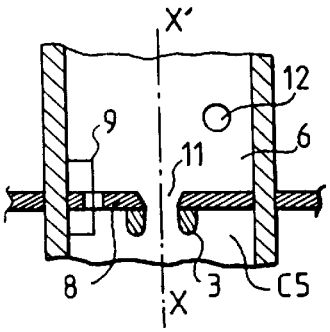
FIG. 3*c* shows a detailed view of a variant of the coupling unit.
Figure 3A:
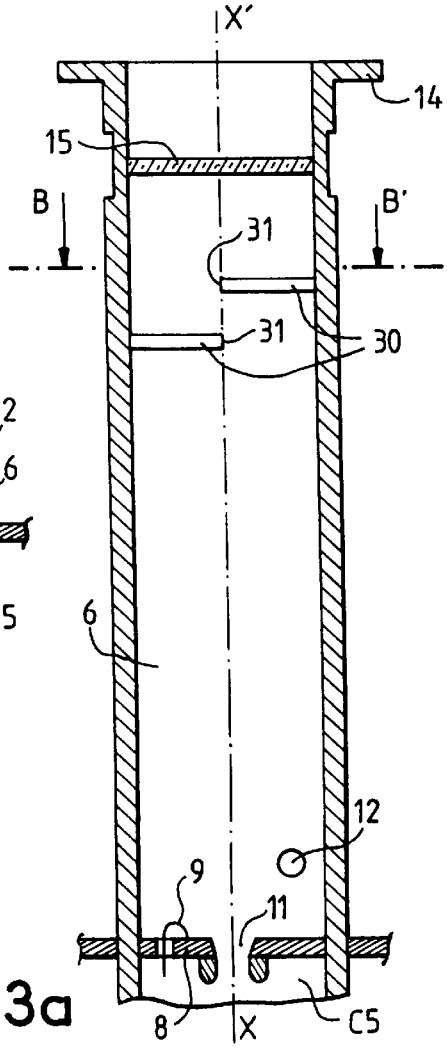
FIGS. 3*a*, 3*b* respectively show a longitudinal section and a cross-section of another variant of a collector of a tube according to the invention.
Figure 3B:
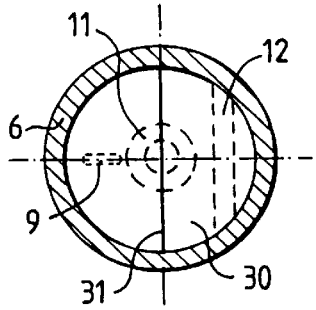

FIGS. 3*a*, 3*b* show a collector 6 of a tube according to the invention fitted out with two partition walls 30. These partitions 30 match the shape of the collector 6. In the example shown, they have facing portions. These portions have edges 31 in the central part of the collector 6. It can also be envisaged that two successive partition walls 30 will have greater facing portions.

These partition walls 30 are positioned towards the end of the collector 6 that is opposite the output cavity C5, upline from the window 15, in a zone where the current of electrons is already well attenuated, as shown in FIG. 3A. These partition walls 30 intercept the electrons that have not yet been collected whatever their origin.

It is possible to use more than two successive partition walls. The space between two successive partition walls 30 will preferably be smaller than $\lambda g/4$, $\lambda g$ representing the length of the microwave guided in the collector.

These partition walls 30 may also be used for matching with the assembly formed by the collector 6, the window 15 and the transmission line if necessary.

FIG. 3*a* shows that the collector 6 contains, as a microwave obstacle 12, a stud instead of a wedge. The coupling unit 9, instead of being an iris, is a conductive loop.

FIG. 3*b*, which is a cross-section of the collector 6 along the section-line BB', shows that the stud 12 and the edges 31 of the partition walls have substantially the same direction and that this direction is substantially normal to the electrical field existing in the collector 6. If the coupling unit 9 were to be an iris as in FIGS. 1, its greatest dimension would have been directed in this direction.

FIG. 3*c* shows a variant of positioning of the loop having one end connected to the wall of the collector 6 and the other end to the wall of the output cavity C5, the loop crossing the terminal wall 8 without touching it.

Figure 4:
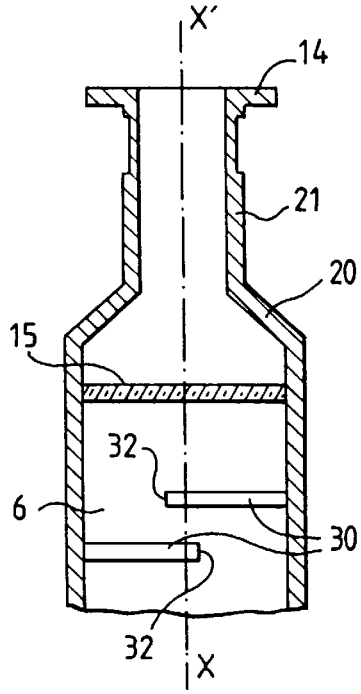
FIG. 4 shows a longitudinal partial section of a collector of a tube according to the invention.

In FIG. 4, the collector 6 has, at its end opposite the output cavity C5, as in FIGS. 2, a transition 20 followed by a waveguide portion 21 to which a junction flange 14 is fixed. The collector 6 is fitted out with two partition walls 30 in the form of baffles. The partition walls have facing portions 32. The window 15 is placed upline from the transition 20 but downline from the partitions 30.

Instead of being directed along the axis XX' of the electron beam, the transmission line 10 may be placed in a direction substantially transversal to this axis. The fragility of the link is no longer a problem in this configuration.

FIGS. 5*a* to 5*f* show various alternative embodiments of collectors 6 ending in a junction flange 14 that is substantially transversal to the axis XX'. The transmission line is mounted in a substantially transversal position, but the window 15 may be substantially transversal to the axis XX' or substantially parallel.

In FIGS. 5*a*–5*f*, the collector 6 is fitted out with partition walls 30 in the form of baffles. It is clear that it could be fitted out with magnets and/or that the window could be covered with a slightly conductive material. These three characteristics could be used alone or in sets of two or all together.

Figure 5A:
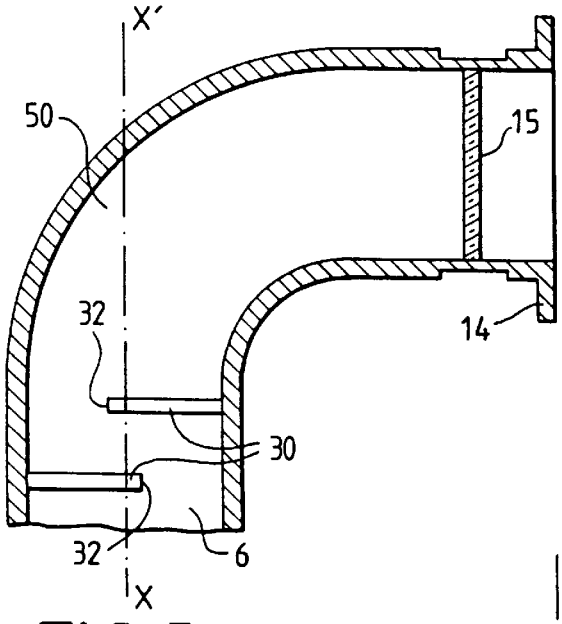
FIG. 5*a* shows a first embodiment of an elbowed collector for tubes according to the present invention.

In FIG. 5*a*, the collector 6 is extended at its end opposite the output cavity by an elbowed portion 50 and ends in the junction flange 14 to which the transmission line (not shown) is to be fixed.

The window 15 is now located beyond the elbowed portion 50, upline from the junction flange 14, and is substantially parallel to the axis XX'. The elbowed portion 50 is herein an elbow waveguide. It is assumed that the collector 6, the elbow waveguide 50, the window 15 and the junction flange 14 have the same cross-section, which may for example be cylindrical or rectangular.

Figure 5B:
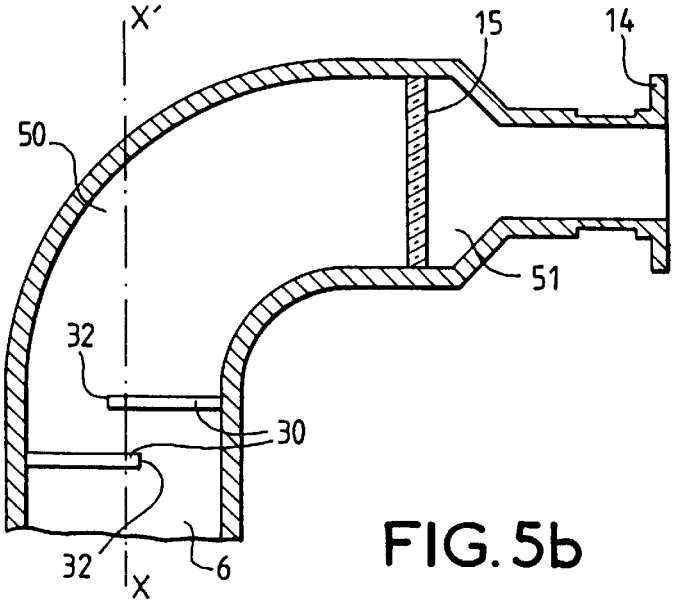
FIG. 5*b* shows a second embodiment of an elbowed collector.

In the same way, in FIG. 5*b*, the collector 6 is extended by an elbow 50 and ends in a junction flange 14. A transition 51 is inserted into the elbow waveguide 50 and the junction flange 14. The transition 51 modifies the cross-section of the collector 6 downline from the waveguide 50.

The collector 6 is for example circular or rectangular. The waveguide 50 preserves the same shape. The transition 51 provides for the passage from the circular to the rectangular shape or from the rectangular to the circular shape or it even, in keeping the same shape, reduces or increases the cross-section.

Figure 5C:
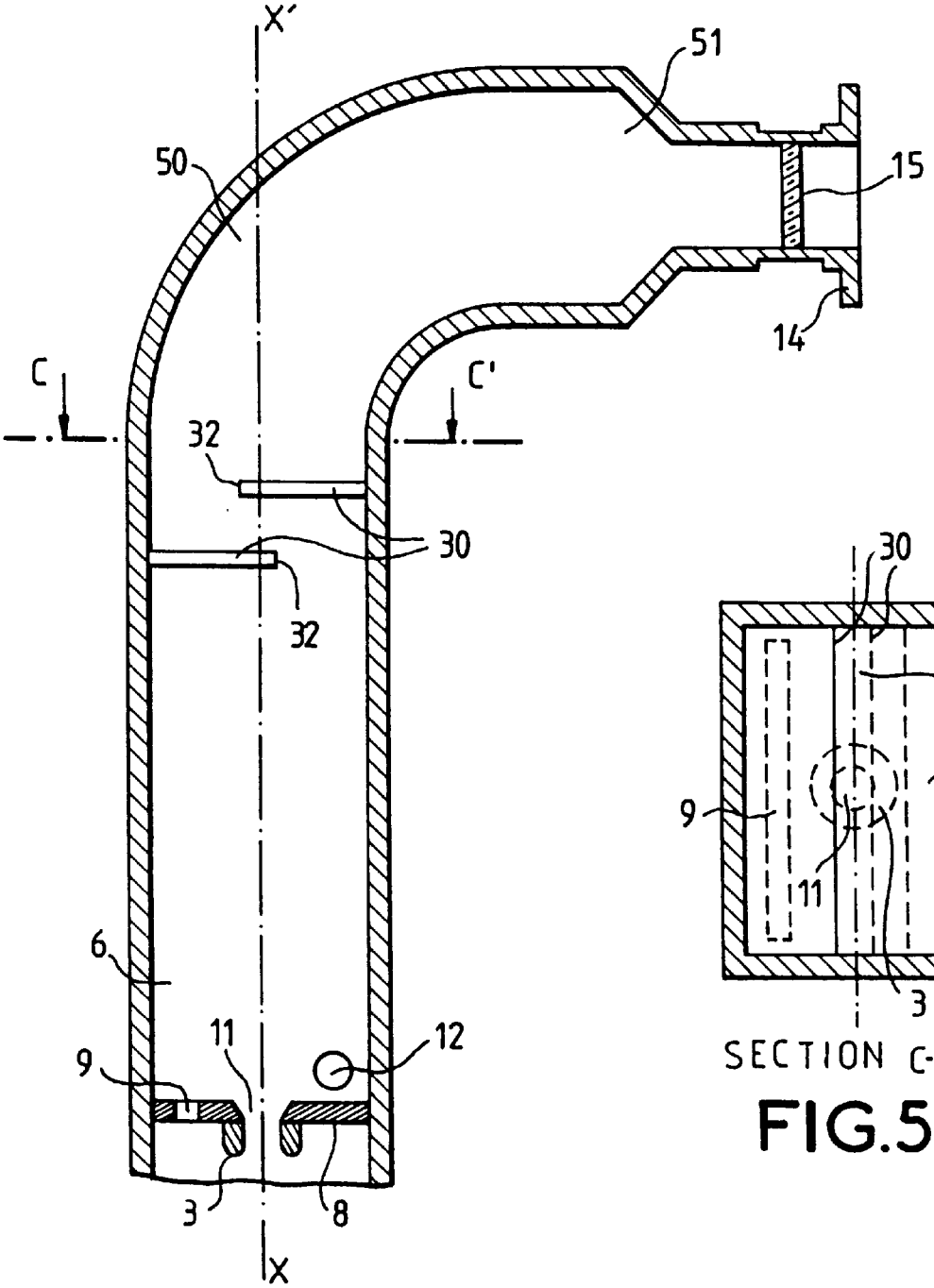
FIG. 5*c* shows a third embodiment of an elbowed collector.
Figure 5D:
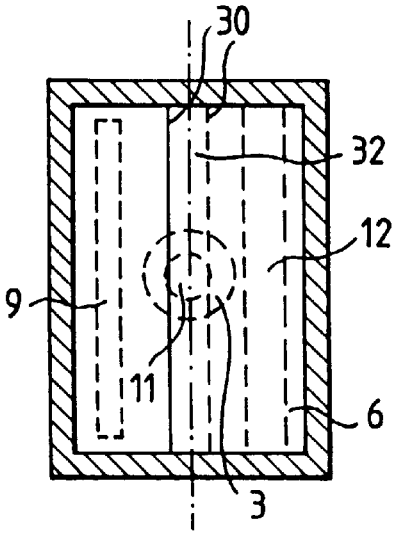
FIG. 5*d* is a sectional view of FIG. 5*c;*

FIGS. 5*c* and 5*d* again show another variant of a collector 6. It has an elbow waveguide 50 (FIG. 3*c*) followed by a transition 51 (FIG. 5*c*) and ends in a junction flange 14. The window 15 is located between the transition 51 and the flange 14. It is assumed in this example that the collector 6 has a rectangular cross-section, that the elbow waveguide 50 is rectangular, that the transition 51 reduces the cross-section of the elbow waveguide 50 while remaining rectangular and that the flange 14 is also rectangular.

FIG. 5*d*, which is a cross-section along the axis CC', shows the iris 9, the stud 12 and the edges of the partition walls 30. All these units are arranged in the same direction.

In this variant, the window 15, placed downline from a reducing transition, has a reduced dimension. This has the advantage of lowering costs.

The advantage of placing the window 15 as close as possible to the flange 14 is that it is easy to obtain access to this window if cleaning is required.

Figure 5E:
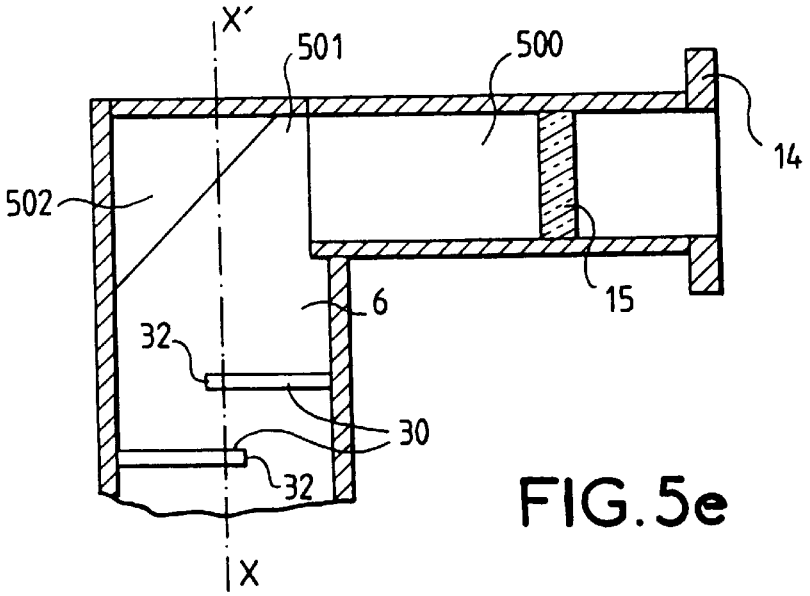
FIG. 5*e* is an embodiment of an angled collector.
Figure 5F:
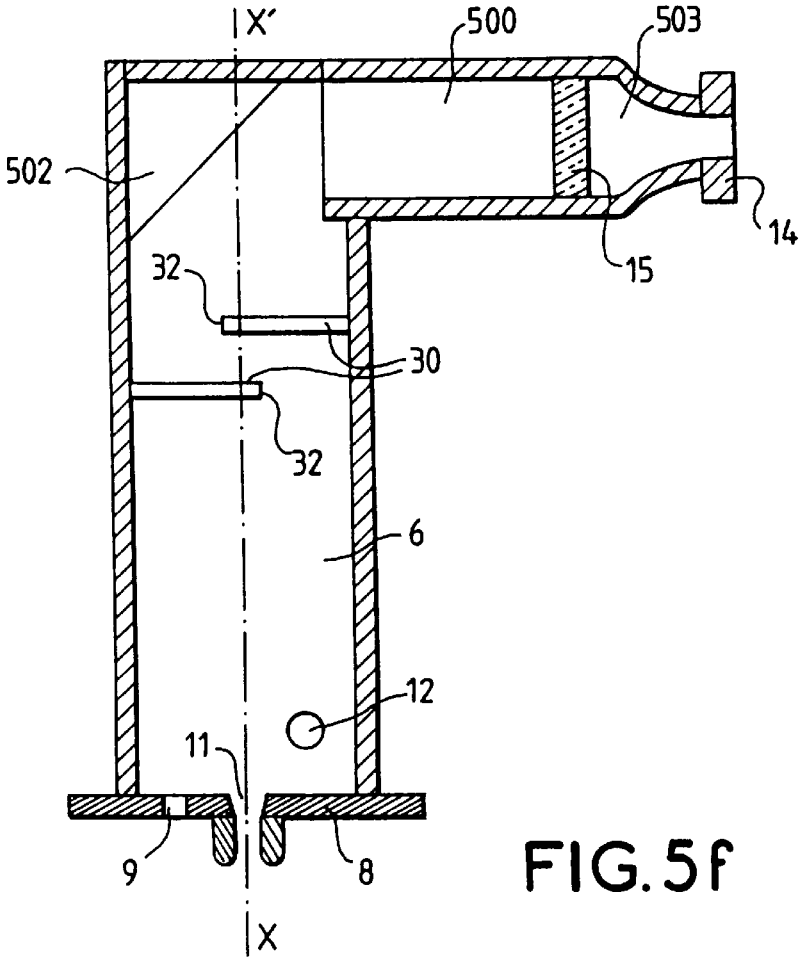
FIG. 5*f* is a further modification of the angled collector of FIG. 5*e.*

Instead of using an elbow waveguide 50 as an elbowed portion, it is possible, as can be seen in FIGS. 5*e* and 5*f*, to fix a waveguide section 500, substantially transversal to the axis XX', directly to the collector 6.

This waveguide section 500 ends, in FIG. 5*e*, in a junction flange 14 designed to be connected to a transmission line (not shown).

The window 15 is placed in this waveguide section 500.

In FIG. 5*e*, the waveguide section 500 has one of its walls in the extension of the end of the collector 6 opposite the output cavity. This end is closed by a wall 501 that is substantially transversal to the axis XX'.

At the junction, there is a matching wedge 502. The dimensions of the cross-sections may be equal or different. The main difference between FIG. 5*e* and FIG. 5*f* is in the waveguide section 500 which comprises a transition 503 (FIG. 5*f*) upline from the junction flange 14. As above, the transition 503 may modify the shape and/or the dimensions of the waveguide section 500. In FIG. 5*f*, this transition 503 provides for a reduction of section without modification of shape. In FIG. 5*f*, the terminal wall 8 can be seen and the coupling unit 9 between the output cavity and the collector 6 is a probe.

The window 15 is placed upline from the transition 503. In order to reduce costs, it could be downline to this transition.

The invention is not limited, with respect to the elbowed portions, the transitions and the position of the window, to the examples shown. Other configurations are possible without departing from the framework of the invention.

What is claimed is:

1. A linear-beam microwave tube comprising at least one electron beam directed along an axis, said at least one electron beam crossing an output cavity, and said electron beam interacting with a microwave signal in said output cavity, wherein said output cavity includes a terminal wall that separates said output cavity from a collector, said terminal wall including at least one aperture in the terminal wall wherein said electron beam penetrates said collector through said at least one aperture, said terminal wall further including at least one coupling unit to couple the microwave signal from the output cavity to the collector, whereby said microwave signal circulates in said collector prior to being extracted from said collector.

2. A microwave tube according to claim 1, wherein the coupling unit is of the iris type.

3. A microwave tube according to claim 1, wherein the coupling unit is a conductive loop.

4. A microwave tube according to claim 1, wherein the collector comprises at least one microwave obstacle in order to match an impedance associated with the collector with an impedance associated with the output cavity.

5. A microwave tube according to claim 1, wherein the collector has one end thereof opposite the output cavity fitted out with a junction flange designed to be connected to a transmission line which extracts the microwave signal out of the collector.

6. A microwave tube according to claim 1, wherein a microwave window is placed in the collector so as to maintain a high vacuum within the collector.

7. A microwave tube according to claim 6, wherein the window is directed so as to be substantially transversal to the axis of the electron beam.

8. A microwave tube according to claim 6, wherein the window is directed so as to be substantially parallel to the axis of the electron beam.

9. A microwave tube according to claim 6, wherein the collector contains successive partition walls mounted as baffles, located upline from the window, designed to protect the window from electron bombardment.

10. A microwave tube according to claim 9, wherein two successive partitions have facing portions.

11. A microwave tube according to claim 10, wherein the facing portions are edges.

12. A microwave tube according to claim 6, wherein the window has one face thereof covered with a low conduction material, so as to enable the flow of electrical charges thereon due to the electron bombardment of the window.

13. A microwave tube according to claim 6, wherein the collector is fitted externally with means for producing a magnetic field aimed at deflecting the electrons before they reach the window.

14. A microwave tube according to claim 1, wherein the collector comprises an elbowed portion.

15. A microwave tube according to claim 1, wherein the collector comprises a transition.

16. A microwave tube according to claim 15, wherein the transition is placed downline with respect to an elbowed portion.

17. A microwave tube according to claim 14, wherein a waveguide section fixed to the collector provides the elbowed portion.

18. A microwave tube according to claim 14, wherein the elbowed portion is an elbowed waveguide.

19. A microwave tube according to claim 14, wherein the window is placed downline with respect to the elbowed portion.

20. A microwave tube according to claim 1, wherein the collector is fitted out externally with a cooling device.

* * * * *